US007341012B2

(12) United States Patent
Loke

(10) Patent No.: US 7,341,012 B2
(45) Date of Patent: Mar. 11, 2008

(54) BARGE WITH TILTABLE CONTAINER

(76) Inventor: Siew Fai Loke, 50 Jalan Limau Nipis, Singapore 468303 (SG)

( * ) Notice: Subject to any disclaimer, the term of this patent is extended or adjusted under 35 U.S.C. 154(b) by 0 days.

(21) Appl. No.: 10/478,782

(22) PCT Filed: May 24, 2002

(86) PCT No.: PCT/SG02/00104

§ 371 (c)(1),
(2), (4) Date: Nov. 24, 2003

(87) PCT Pub. No.: WO02/094651

PCT Pub. Date: Nov. 28, 2002

(65) Prior Publication Data

US 2004/0165971 A1 Aug. 26, 2004

(30) Foreign Application Priority Data

May 25, 2001 (SG) ..... 2001031673

(51) Int. Cl.
*B63B 35/30* (2006.01)
*B63B 25/04* (2006.01)
*E02B 3/18* (2006.01)

(52) U.S. Cl. ..... 114/27; 114/31; 114/32; 114/73; 414/140.9

(58) Field of Classification Search ..... 114/26–38, 114/260, 72, 73; 414/137.1, 140.9, 141.1, 414/141.2, 142.2; 37/307, 340, 341; 405/15–17
See application file for complete search history.

(56) References Cited

U.S. PATENT DOCUMENTS 213,387 A * 3/1879 Church et al. ..... 114/33
227,019 A * 4/1880 Knuth ..... 114/32
273,178 A * 2/1883 Souther ..... 114/33
289,498 A * 12/1883 Brainard ..... 114/32
502,142 A * 7/1893 Ryan ..... 114/32
590,594 A * 9/1897 Scripture ..... 414/680
656,509 A * 8/1900 Bullis ..... 114/32
659,239 A * 10/1900 Lawson ..... 114/33
1,917,434 A * 7/1933 Dade ..... 114/32
2,938,487 A * 5/1960 Franke ..... 114/32
3,111,102 A * 11/1963 Gorton, Jr. ..... 114/32
3,556,036 A 1/1971 Wells
4,898,112 A 2/1990 McGlew et al.

FOREIGN PATENT DOCUMENTS

AU 23122 /67 12/1968
GB 2334485 8/1999
JP 54027119 A * 3/1979
JP 54104190 A * 8/1979
JP 54113187 A * 9/1979
JP 55036108 A * 3/1980

(Continued)

*Primary Examiner*—Ajay Vasudeva
(74) *Attorney, Agent, or Firm*—Brooks Kushman P.C.

(57) ABSTRACT

The present invention relates to a barge with an open top container for receiving a cargo mounted on the deck characterized in that the container is pivotally mounted on the deck such that cargo (e.g. marine sand) can be discharged from the barge by tilting of the container about the pivotal axis. The barge is particularly useful for use in land reclamation projects and the invention further relates to a method of reclaiming land utilizing such barges.

9 Claims, 1 Drawing Sheet

FOREIGN PATENT DOCUMENTS

| | | | | |
|---|---|---|---|---|
| JP | 57108334 | A | * | 7/1982 |
| JP | 57116818 | A | * | 7/1982 |
| JP | 58097586 | A | * | 6/1983 |
| JP | 62137308 | A | * | 6/1987 |
| JP | 62137309 | A | * | 6/1987 |
| JP | 07101556 | A | * | 4/1995 |
| JP | 11227681 | | | 8/1999 |
| SU | 772917 | | | 10/1980 |
| SU | 887353 | | | 12/1981 |

* cited by examiner

BARGE WITH TILTABLE CONTAINER

CROSS-REFERENCE TO RELATED APPLICATION

This application claims priority to PCT Appln. No. PCT/SG02/00104, filed May 24, 2002, and to Singapore application 200103167-3, filed May 25, 2001.

BACKGROUND OF THE INVENTION

1. Field of the Invention

The present invention relates to a barge for use in the bulk transport of materials.

2. Description of the Related Art

One important use of marine barges is in the bulk transfer of materials used in land reclamation projects. Such projects require the transport of large volumes of aggregates (sand and the like) that are dredged at one location (e.g. from the seabed), loaded onto the barges and discharged at a site where land is being reclaimed. To date land reclamation projects have employed hopper barges and dump barges to move aggregates to a desired site.

Hopper barges comprise a large hulled vessel containing a number of hatch compartments with hopper gates mounted at the bottom of the hatch compartment. In use Hopper barges are anchored at a supply site, where material is loaded into the hatches of the hopper barge or drawn from the sea-bed or river bed and pumped (e.g. using a suction dredger) in semi-liquid form into the hatches of the hopper barge. Once the hatches are full the Hopper barge moves to the reclamation site to unload its cargo. Discharging is carried out by opening hopper gates located in the bottom of the hatches below the water line. It is crucial to ensure that the barge operates in water of sufficient depth. If the water is too shallow the barge may become grounded on the material released through the hoppers. Once the material has been discharged the hopper barge travels back to the supply site and the cycle repeats.

Hopper barges are able to quickly unload materials at the target site. However, it requires deep water for its hopper gate maneuver. Such barges therefore have the disadvantage that they are not able to operate in shallow waters.

The inability of hopper barges to operate in shallow waters is attributed to a number of factors including:

(1) The hatch compartment is located within the center core of the vessel, sandwiched and surrounded by its hull. This means the vessel must be designed such that the holding compartment only comprises about one third of the vessels volume in order that reasonable buoyancy and stability standards may be maintained. This required volume is a disadvantage in itself but also has the effect that the barge cannot operate in shallow waters.

(2) The hopper barge must be in water that is sufficiently deep enough to allow the hopper gates to swing open. It is particularly important that there is sufficient room for the gates to close when the cargo has been discharged.

A further disadvantage associated with hopper barges is that they are prone to mechanical failure. The mechanical system that operates the hopper gate often breaks down due to exposure to sea water as well as contact, wear and tear with gravel material. Accordingly hopper barges also suffer from high maintenance costs and the capital cost of a hopper barge is high, relative to a dump barge (see below) capable of transporting an equivalent cargo volume.

Dump Barges are large vessels with large capacity open decks that may be loaded with a cargo. In use the dump barge is anchored at a supply site where material is loaded onto the open deck of the dump barge or drawn from the sea-bed or river bed and pumped (e.g. using a suction dredger) in semi-liquid form onto the top open deck of the dump barge. Once the barge is loaded to capacity it is moved to the reclamation site and the cargo discharged. The material is discharged by opening up side fender gates surrounding the loaded deck and then pushing out the material directly from the deck side. Pushing activity may be carried out manually or by mechanical shovel (e.g. a bulldozer). Once unloaded the barge travels back to the supply site and the cycle repeats.

Dump barges have the advantage that they can operate in shallow water or may even be beached before the unloading process begins. The ability of a dump barge to operate in shallow waters is related to the fact that the vessel has a high buoyancy value. This is because its hull is empty right to the bottom (unlike hopper barges) and the vessel is also rectangular in cross-section.

Furthermore, the shape of dump barges offers a high holding capacity (generally superior to hopper barges) because the entire top, open deck is engineered to receive cargo. Loading capacity is determined during the registration of a vessel with an approved authority. Construction, engineering features, technical specifications and age are taken into consideration. Generally speaking dump barges are allocated greater loading capacities than hopper barges.

Despite the above mentioned advantages of dump barges, they have a major draw back in that the unloading process is very slow even with the aid of individual mechanical shovels, bulldozers and the like. This is because movement of mechanical shovels and the like is hampered by the sheer volume of a fully loaded cargo deck. Assigning additional or higher capacity stand-in equipment not only cannot resolve the problem, but also adds cost and also reduces the capacity of its holding area. Under such physical constraints land-fill material can only be pushed in to the sea, shovel by shovel, by a limited allowable number of on-board stand-in equipment. This is cumbersome and time consuming.

SUMMARY OF THE INVENTION

It will be appreciated from the above that it is desirable to provide a barge that is capable of operating in shallow waters and which can also be unloaded quickly. Accordingly it is an object of the present invention to provide a barge that fulfils this criteria and/or overcomes other disadvantages associated with prior art vessels.

According to a first aspect of the present invention there is provided a barge with an open top container for receiving a cargo mounted on the deck characterised in that the container is pivotally mounted on the deck such that cargo can be discharged from the barge by tilting of the container about the pivotal axis.

A barge according to the present invention has the advantage that it is capable of operating in shallow water yet can quickly discharge cargo. Accordingly the inventor has combined the advantages of a Hopper barge with that of a dump barge whilst avoiding the disadvantages associated with both.

Barges according to the invention also have the benefit that they do not require a large crew. Typically a barge according to the present invention will need approximately half the number of crew compared to that required on an equivalent capacity hopper barge.

Furthermore barges according to the present invention are easy to construct, operate and maintain. They therefore involve low capital cost. The barges are also durable, versatile and extremely efficient for targeted discharging of a cargo.

Barges according to the present invention are ideal for use in land reclamation projects. When this is the case the cargo is an aggregate such as soil, gravel, rocks, sand and the like. Preferably the cargo is marine sand. This use represents an important feature of the invention and according to a second aspect of the invention there is provided a method of reclaiming land comprising:

(i) loading aggregate into an open top container pivotally mounted on the deck of a barge;

(ii) moving the barge to a site at which land is to be reclaimed; and (iii) causing the container to be tilted about the pivotal axis such that the aggregate is discharged from the barge;

Preferably the method comprises the extra step of (iv) repeating the process until the aggregate at the reclamation site is above sea-level.

The barge may also be used for general transport purposes and accordingly the cargo may be chosen from a variety of goods. For instance, the cargo may also be coal, mineral or grains (e.g. maize).

It is preferred that the underside of one end of the container is hinged onto the deck of the barge and the other is hooked onto a mechanical underpinning system, activated by hydraulics in the deck. When the underpinning system is activated (e.g. remotely from the crew cabin), a pusher piston shaft may rise from the deck and push one edge of the container upwards, while the hinge at the other end acts as a pivot point. Therefore the container tilts and discharges the cargo from the barge. It is preferred that the containers are arranged such that the cargo may be discharged over the sides of the barge.

The underpinning system may comprise a main hydraulic pump which in turn distributes hydraulic energy to power the movements of the pusher piston mounted underneath the, or each, container.

Alternatively the underside of one end of the container may be hinged onto the deck of the barge and the other may be hooked onto a cranage lifting system.

Preferably the container tilts such that an angle of between about 0° to 60° is defined between the underside of the container and the deck. This angle of inclination has been found to be sufficient for discharging an aggregate cargo such as sand or earth from the barge.

The whole discharging process and container withdrawal is preferably performed within 30 seconds.

It is preferred that the barge comprises more than one container. More than one container may be tilted at a time to allow simultaneous discharge of cargo. Synchronisation of container discharging enables optimization of buoyancy of the barge helps to avoid the possibility of capsizing.

The barge preferably has a plurality of containers arranged on the deck in two rows from bow to stern. When the containers are arranged in this fashion the barge may be a dump barge or similar vessel with a flat top open deck. The deck of the barge may contain a large number of containers that break down the cargo area of the barge into relatively smaller holding units. The containers may be individually tilted to dispense the cargo. Such an arrangement divides and spreads the cargo into relatively light and manageable masses that may be discharged over the side of the vessel without unduly affecting the buoyancy of the barge. The containers preferably are pivotably hinged to the deck about an axis adjacent to the lateral edge of the container and parallel to a midline of the barge deck.

BRIEF DESCRIPTION OF THE DRAWINGS

The present invention will be further illustrated in the example and accompanying drawings in which.

DETAILED DESCRIPTION OF THE INVENTION

Figure 1:
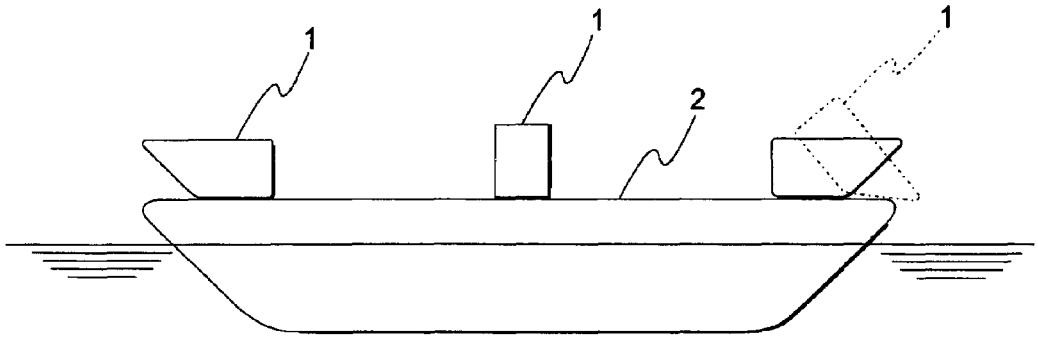
FIG. 1 is an elevation view of a barge according to the invention.
Figure 2:
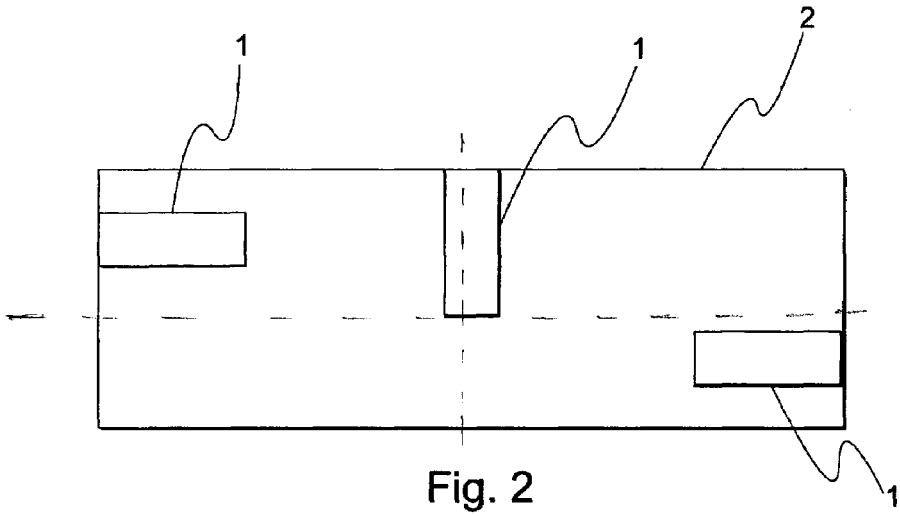
FIG. 2 is a plan view of a barge according to the invention.
Figure 3:
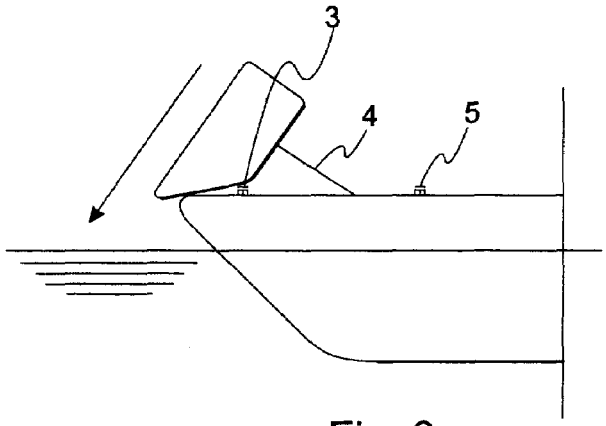
FIG. 3 is a detailed elevation view of the barge according to the invention.

FIG. 1 and FIG. 2 illustrate elevation and plan views of a barge according to the present invention. Containers (1) are shown mounted on the deck (2). FIG. 3 represents a more detailed elevation view of a section of a barge, showing the pivotal mounting (3) of a container (1) and also a pusher piston shaft (4) for tilting the container.

The invention claimed is:

1. A barge for transporting bulk cargo, the barge being adapted to be moved from a loading location to a unloading location, the barge comprising:

an enclosed shallow draft flat bottom hull defining an upper deck surface with an outer periphery, the hull not having associated therewith a system for propelling the barge;

a plurality of open top containers for receiving bulk cargo, each container having a closed base, an open top, and four walls rigidly attached to the base and extending between the base and the open top, each of the plurality of open top containers being mounted on the hull deck surface adjacent the outer periphery and pivotable between an upright storage position in which the bulk cargo is supported within the open top container and a tipped inclined discharge position in which the bulk cargo is allowed to be discharged out of the container only through the open top; and a plurality of hydraulically driven piston assemblies for moving the plurality of open top containers between the upright storage position and the inclined discharge position.

2. A barge according to claim 1 wherein the container is pivotally hinged to the deck on an axis parallel to the mid line of a deck adjacent the lateral edge of the container.

3. A barge according to claim 1 wherein the underside of one end of the container is hinged onto the deck of the barge and the opposite end is releasably hooked onto a mechanical underpinning system on the deck.

4. A barge according to claim 3 wherein the underpinning system comprises hydraulics in the deck which when activated cause the hydraulically driven piston assembly to rise from the deck and push one edge of the container upwards, while the hinge at the other end acts as a pivot point to allow the container to tilt and discharge the cargo from the barge.

5. A barge according to claim 1 wherein the containers are arranged such that the cargo may be discharged over the sides of the barge.

6. A barge according to claim 1 wherein the plurality of containers are located adjacent more than one of the barge deck peripheral side edges.

7. A barge according to claim 6 wherein the containers are arranged on the deck in two rows from bow to stern.

8. A method of reclaiming land from a body of water comprising:

(i) providing a barge for transporting bulk cargo, the barge being adapted to be moved from a loading location to a unloading location, the barge comprising an enclosed shallow draft flat bottom hull defining an upper deck surface with an outer periphery, the hull not having associated therewith a system for propelling the barge; a plurality of open top containers for receiving bulk cargo, each container having a closed base, an open top, and four walls rigidly attached to the base and extending between the base and the open top, each of the plurality of open top containers being mounted on the hull deck surface adjacent the outer periphery and pivotable between an upright storage position in which the bulk cargo is supported within the open top container and a tipped inclined discharge position in which the bulk cargo is allowed to be discharged out of the container only through the open top; and a plurality of hydraulically driven piston assemblies for moving the plurality of open top containers between the upright storage position and the inclined discharge position;

(ii) moving the barge loaded with aggregate using the motorized vessel to a site at which land is to be reclaimed; and (iii) causing the container to be tilted about the pivotal axis such that the aggregate is discharged from the barge into the body of water.

9. The method according to claim 8 comprising the extra step of:

(iv) repeating the process until the aggregate at the reclamation site is above sea-level.

* * * * *